United States Patent [19]

Hall

[11] 4,189,075

[45] Feb. 19, 1980

[54] PACKFRAME-CANTEEN

[76] Inventor: John O. Hall, 222 E. Riverside Dr., #332, Austin, Tex. 78704

[21] Appl. No.: 879,277

[22] Filed: Feb. 21, 1978

[51] Int. Cl.[2] ..... A45F 5/00

[52] U.S. Cl. ..... 224/148; 224/261

[58] Field of Search ..... 222/129, 78; 224/5 W, 224/25 A, 8 A, 148, 210, 211, 212, 213, 261, 262, 263; 220/20.5, 21

[56] References Cited

U.S. PATENT DOCUMENTS

| | | | |
|---|---|---|---|
| 3,246,644 | 4/1966 | Peterson | 224/25 A X |
| 3,797,718 | 3/1974 | Plant | 224/25 A |
| 3,877,611 | 4/1975 | Morrison et al. | 222/78 |
| 3,902,640 | 9/1975 | Geiben | 224/5 W |

*Primary Examiner*—Joseph J. Rolla

*Attorney, Agent, or Firm*—Staas & Halsey

[57] ABSTRACT

A combination canteen and packframe for hikers employing the hollow tubing and structural members of the packframe to store fluids, such as water and fuel, and having closable apertures for filling and draining. The horizontal tubing of the packframe allows fluid to communicate from one vertical tube to the other, and a pump may be mounted in the packframe for pressurizing the fluid stored therein.

16 Claims, 6 Drawing Figures

PACKFRAME-CANTEEN

BACKGROUND OF THE INVENTION

1. Field of the Invention

The present invention is related to packframes employing supporting frames of tubing or other hollow structural members as used by hikers for supporting their packs and to improvements in those packframes by utilizing the empty space within said tubing, together with any desirable modifications of the configuration of the tubing, for storing, transporting and pressurizing fluids in order to achieve certain advantages in weight, balance, space utilization, durability, and protection from odor.

2. Description of the Prior Art

Of all the commodities carried by hikers for their comfort and survival, fluids are among the heaviest. The fluids most commonly carried are water and fuel, weighing about 8.3 pounds per gallon, plus the weight of the containers.

The daily consumption of water is usually one gallon per day or more, constituting a weight of about six times that of food consumed per day. The total amount of water carried depends upon availability of supply along the trail, the number of days to be hiked, and the strength and endurance of the hiker. Whenever water is plentiful the quantity carried may perhaps be only a quart, but in desert areas it may be considerably more.

The water is usually placed in metal or plastic canteens and carried within the pack for convenience and weight economy of the container. A minority of hikers carry them separately, in cases, attached to belt or hanging by straps from the shoulder. Placing the canteens inside the pack uses up a relatively large amount of space, thus requiring larger packs than otherwise would be necessary. The approximately 280 cubic inches of space for each gallon of water and container equals 10 percent of the capacity of a popular-size pack containing 2,800 cubic inches of space.

Carrying water in a pack also creates three major problems of weight distribution for the hiker. First, it requires him to lean forward to compensate for the backward pull of the water's weight on his back. Second, because of the height at which the water containers are carried in the pack, as well as the weight-shifting tendency of the water within both container and pack, the hiker has less control over his balance, especially when traveling uneven terrain. Carrying the water high in the pack and close to the body partially offsets the first problem but aggravates the second, and vice versa. Third, care is required, as water is consumed, that the remaining supply is not located mostly on one side of the pack so as to create an imbalance in weight.

Another disadvantage of carrying water inside the pack is the inconvenience of access, requiring the hiker to remove the pack from his back and open it each time he wants a drink, which tends to be frequent because of the energy expended in hiking.

Although the wilderness environment was once relied upon to provide fuel for cooking, conservation now requires that most backpackers carry stoves, many of which require a liquid petroleum-base fuel, either kerosene or white gasoline. This fuel is normally carried in one or more metal containers placed inside the pack. Carrying the fuel in the pack creates similar problems of space, weight, and balance as in the case of water, plus another which is particularly inconvenient, leakage and odor. Despite all efforts, the fumes usually penetrate food, clothing, and other supplies.

Packframes have improved in recent years from crude, heavy wooden frames to light-weight (usually aluminum-alloy) frames with structural variations according to the size and design of the pack to be carried and individual needs for attaching additional equipment to the frame such as sleeping bags, tents, etc. The strength of the packframes varies, with an inherent conflict of strength versus weight always being a factor in their design. The single objective of the packframe has been that of supporting the pack itself while carried by a hiker, plus any sufficient strength necessary to maintain its shape during normal handling after removal by the hiker. In practice the compromises made in order to lower the weight of the packframe have resulted in fragility which often leads to bent and damaged frames. However, this is a situation which can be improved if the packframe is made to serve one or more additional objectives and to concomitantly offer advantages to compensate for any increase in packframe weight, as proposed by this invention.

Canteens, except for the utilization of new materials such as plastic, have changed relatively little over the years, and remain essentially bottles. They serve no other purpose than containing fluids.

SUMMARY OF THE INVENTION

The present invention provides an improved means for storing and carrying water and fuel in a backpack by utilizing the hollow structural members of the packframe for this purpose. The tubing of the packframe, made tight to contain fluid, constitutes a canteen or canteens for either one or two fluids, such as water, fuel, or both. Each canteen is equipped with a closeable inlet for filling with fluid, an outlet for drainage with a cock or other means for controlling and shutting off flow, a closeable air hole to allow ready hydraulic flow from the outlet, and baffles inside the tubing impeding rapid flow from one section of the tubing to another in order not to prejudice the balance of the hiker in his movements.

The structure of the packframe may be altered or enlarged to increase the fluid storage capacity by increasing the size or shape of the hollow structural members while at the same time strengthening the frame, improving weight distribution of the backpack through moving more of the total weight toward the center of gravity of the body, and reducing the size and weight of the pack attached to the frame in an amount corresponding to the volume of fluids no longer stored there.

Flexible tubing may be attached to the fluid outlet or outlets for convenience in transporting water to a cup or other container, and fuel to the tank of a stove. The ends of each such tube may be equipped, optionally, with a closeable nozzle or clamp. The flexible water tube may be extended to enable a hiker to obtain water without removing the backback from his back.

The frame may be converted into a pressure tank for fuel to be used in a camp stove or lantern by providing a pressure pump inserted or otherwise connected to the packframe and utilizing pressure tubing, either rigid or flexible, from the packframe to the stove or lantern. In so doing, the weight of the tank normally connected to stove or lantern is eliminated less the weight of the pressure tubing.

One object of the present invention is to reduce the size and weight of the hiker's pack by an amount corresponding to the volume of fluid no longer stored herein. Part of the weight savings due to the deletion of previously required separate fluid containers and due to the reduced volume requirements of the pack may be used to equip the packframe for storing fluids. The balance of the weight savings may be used to reduce the total weight of the backpack. Any increase in the packframe's weight in order to increase its fluid holding capacity correspondingly increases its strength.

Another object of the present invention is to improve the weight distribution of the hiker's load, allowing him to carry more without tiring. The weight of the fluids is carried closer to the hiker's body, which enables him to use a more upright and natural stance. The hiker's balance is improved since the center of gravity of the fluids is lowered.

Another object of the present invention is to allow the hiker to drink from the backpack while carrying it in its normal hiking position.

Still another object of the present invention is to increase the security of fluids that might otherwise be carried in a fragile plastic containers inside the pack. Contamination of food and other supplies from leakage and odors to fuel containers stored in the pack is eliminated An additional object of the present invention is to permit conversion of part or all of the packframe into a pressure tank for fueling a camp stove or lantern.

DESCRIPTION OF THE PREFERRED EMBODIMENTS

Figure 1:
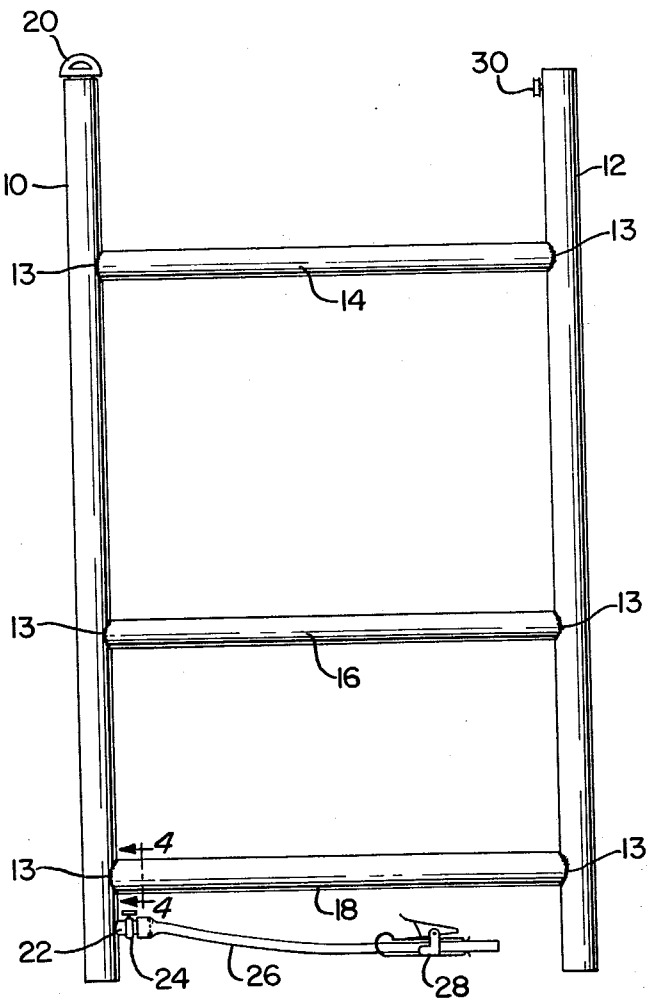
FIG. 1 is a front view of an embodiment in which the packframe-canteen contains a single fluid.

The packframe-canteen of the present invention is illustrated in FIG. 1, and consists of fluid-tight vertical tubes 10 and 12 which are joined, at fluid-tight but internally open junctions 13, to transverse members such as tubes 14, 16, and 18. Tube 10 is provided with fluid-tight closable inlet 20 for filling the packframe-canteen and outlet 22 with cock 24 for draining it. Cock 24 may be omitted if flexible tube 26 terminated by clamp 28 is coupled to outlet 22. Vertical tube 12 is illustrated with closable air hole 30 to facilitate drainage, but it is apparent that closable inlet 20 could be provided with a breather hole instead.

Figure 3:
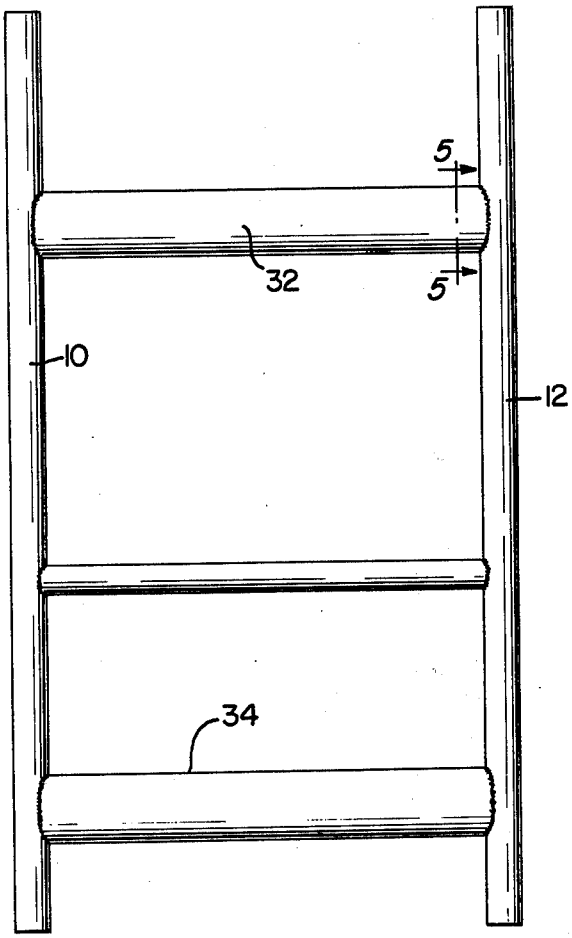
FIG. 3 is a front view illustrating the packframe-canteen with enlarged structural members to increase its fluid capacity.
Figure 4:
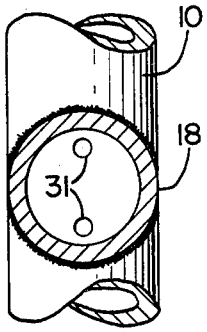
FIG. 4 is a sectional view taken along the line 4—4 of FIG. 1, illustrating a baffle for impeding rapid fluid shifting.
Figure 5:
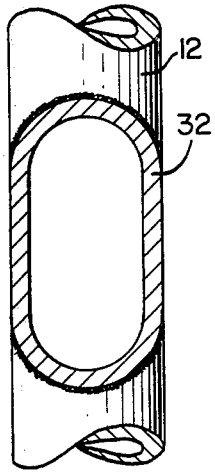
FIG. 5 is a sectional view taken along the line 5—5 of FIG. 3, illustrating the cross-section of an enlarged structural member.

Fluid can be prevented from shifting too rapidly when the hiker transverses uneven terrain by providing tubes 14, 16 and 18 with baffles, such as the simple construction illustrated in FIG. 4. There, holes 31 in vertical tube 10 are provided at the junction 13 between tubes 10 and 18. Similar baffles at other junctions 13 are provided to allow fluid to flow slowly from one vertical tube to the other, thereby maintaining an approximately equal load in each while impeding rapid fluid flow which might impair the hiker's balance. It will be apparent that the packframe-canteen's fluid capacity is maximized if fluid is allowed to communicate from one vertical tube to the other through each transverse tube, and that at least one baffle should be provided per transverse tube that is open for such communication. It will also be apparent that fluid capacity can be increased by using larger transverse tubes, such as tubes 32 and 34 in FIGS. 3 and 5.

Figure 2:
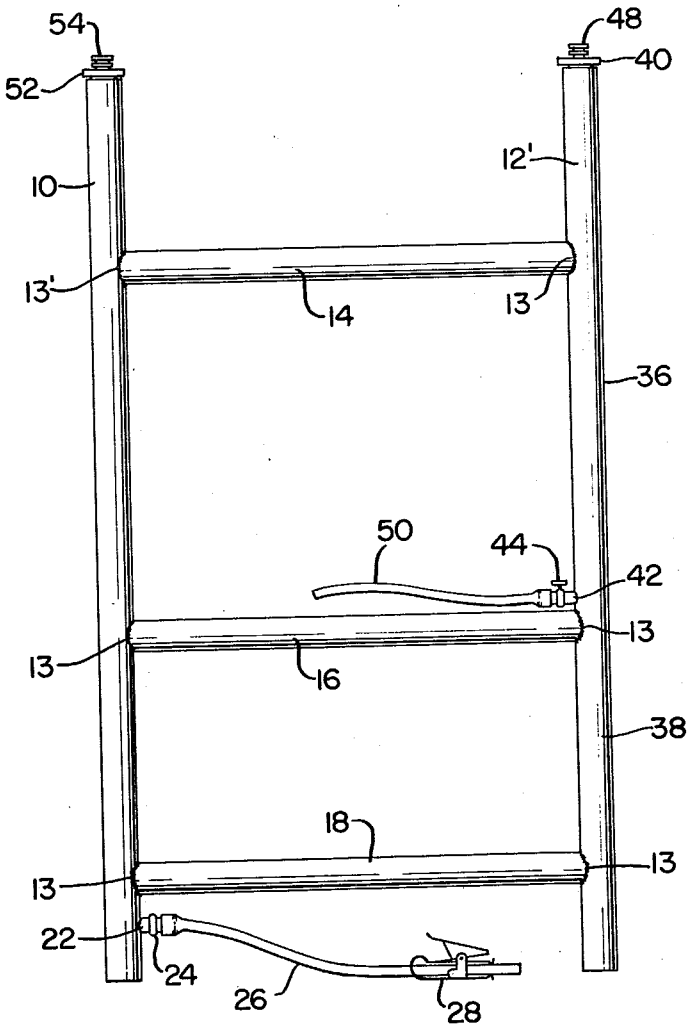
FIG. 2 is a front view of a second embodiment in which the packframe-canteen contains two fluids.

The alternate embodiment illustrated in FIG. 2 contemplates multiple, non-communicating chambers in a single packframe. Tube 12' is composed of sections 36 and 38, which are isolated from each other so that their contents do not mix. Section 36 is provided with closable inlet 40 for filling the chamber and outlet 42 with cock 44 for draining it. Closable air hole 48 in inlet 40 facilitates fluid flow. Similarly, tube 10 is provided with closable inlet 52 and its closable air hole 54. Flexible tube 50 may be coupled to outlet 42 to promote utility.

Junction 13' in the alternative embodiment is a mechanical connection only, and must be fluid-tight so as to prevent the stored fluids from mixing. The remaining junctions 13 illustrated in FIG. 2 may be internally open to increase fluid capacity and even the load, but they should be internally baffled as previously described.

Figure 6:
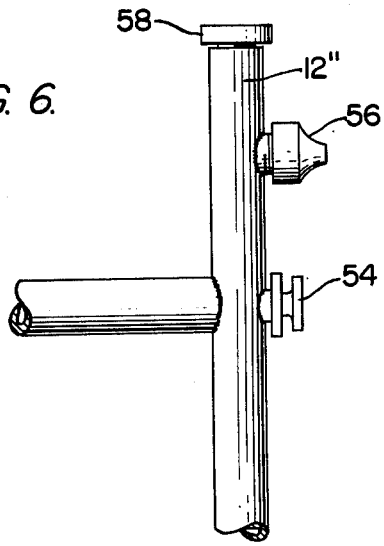
FIG. 6 is a view illustrating a packframe with pressurizing apparatus.

The packframe may be provided with pressure pumps and associated apparatuses for pressurizing one or more of the fluids contained therein. In FIG. 6, for example, fuel may be contained in the illustrated portion of tube 12''. Air pressure pump 54 is provided for pressurizing the fuel, and safety valve 56 may also be employed. Fuel is introduced into the packframe by way of closeable, airtight fuel inlet 58, and may be removed for use by way of tubing connected to an outlet (not shown) and shut-off valve (not shown) provided in tube 12''.

It will be apparent that the invention disclosed herein can be readily modified to meet some applications. For example, flexible insulation could be applied to lower thermal conductivity through the tubes and to pad them for the hiker's comfort. Additionally, in some applications it might be desirable to line internal sufaces with material resistant to the fluid to be contained. It should also be apparent that in some applications a single external opening, rather than the three disclosed, may be used.

I claim:

1. A fluid-tight packframe structure for carrying a load or supply on an individual's back, said packframe having a top end and a bottom end when worn upon the back of an individual, wherein the improvement comprises: means for storing fluid within said packframe when said packframe is worn; a closable inlet mounted at the top of said packframe; and means disposed above the bottom end of said packframe for draining fluids stored therein.

2. The packframe of claim 1, wherein said packframe has two vertical fluid storage tubes spaced apart one from the other, and at least one transverse tube through which fluid can communicate from one of said vertical tubes to the other, each said at least one transverse tube being shorter than either of said vertical tubes and intersecting each of said vertical tubes substantially at right angles.

3. The packframe of claim 2, further comprising means for increasing internal pressure within said packframe.

4. The packframe of claim 3, wherein said means for increasing internal pressure is an air pump.

5. The packframe of claim 3, further comprising a safety valve for preventing excessive pressure.

6. A fluid-tight packframe, comprising: two vertical fluid storage tubes; at least one transverse tube through which fluid can communicate from one of said vertical tubes to the other; at least one baffle in each of said transverse tubes; and means for filling and draining fluids from said packframe.

7. The packframe of claim 6, wherein said means for filling and draining fluids comprises a closable inlet and a closable outlet.

8. The packframe of claim 6, wherein said means for filling and draining fluids comprises an air hole, a closable inlet, and a closable outlet equipped with a tube.

9. A packframe structure for carrying a load or supply on an individual's back, said packframe having a top end and a bottom end when worn upon the back of an individual, wherein the improvement comprises a plurality of fluid-tight chambers within said packframe and means disposed above the bottom end of said packframe for filling and draining fluids from said chambers.

10. The packframe of claim 9, wherein said packframe has two vertical tubes and at least one of said fluid-tight chambers comprises a transverse tube through which fluid can communicate from one of said vertical tubes to the other.

11. The packframe of claim 9, further comprising means for increasing internal pressure within at least one of said chambers.

12. The packframe of claim 11, wherein said means for increasing internal pressure comprises at least one air pump.

13. The packframe of claim 11, further comprising at least one safety valve for preventing excessive pressure.

14. A packframe of the type having two vertical tubes and at least one transverse tube connecting said vertical tubes, wherein the improvement comprises: at least one baffle; a plurality of fluid-tight chambers within said packframe, at least one of said chambers communicating through a transverse tube having said at least one baffle therein; and means for filling and draining fluids from said chambers.

15. The packframe of claim 14, wherein said means for filling and draining said chambers comprises a closable inlet and a closable outlet.

16. The packframe of claim 15, wherein said means for filling and draining said chambers comprises a air hole, a closable inlet, and a closable outlet equipped with a tube.

* * * * *